US005852756A

United States Patent [19]

Teranishi et al.

[11] Patent Number: 5,852,756

[45] Date of Patent: Dec. 22, 1998

[54] METHOD OF ADJUSTING IMAGE FORMING CONDITIONS AND IMAGE FORMING APPARATUS TO WHICH THE METHOD IS APPLIED

[75] Inventors: Katsuyuki Teranishi; Takeshi Arakawa, both of Osaka, Japan

[73] Assignee: Mita Industrial Co., Ltd., Osaka, Japan

[21] Appl. No.: 955,295

[22] Filed: Oct. 21, 1997

[30] Foreign Application Priority Data

Oct. 25, 1996 [JP] Japan ..... 8-284310

[51] Int. Cl.[6] ..... G03G 15/00

[52] U.S. Cl. ..... 399/44; 399/50; 399/51; 399/58

[58] Field of Search ..... 399/44, 46, 49, 399/50, 51, 53, 55, 66, 58, 97

[56] References Cited

U.S. PATENT DOCUMENTS 5,034,772 7/1991 Suzuki ..... 399/44
5,146,273 9/1992 Yamada ..... 399/44 X
5,146,274 9/1992 Hattori et al. ..... 399/44
5,473,415 12/1995 Hayashi et al. ..... 399/44
5,708,917 1/1998 Kawai et al. ..... 399/44 X

FOREIGN PATENT DOCUMENTS 5-100513 4/1993 Japan .

*Primary Examiner*—Arthur T. Grimley
*Assistant Examiner*—Sophia S. Chen
*Attorney, Agent, or Firm*—Beveridge, DeGrandi, Weilacher & Young, LLP

[57] ABSTRACT

In a method of adjusting image forming conditions according to the present invention, it is judged whether or not a humidity detected by a humidity sensor is not less than a predetermined first humidity $H_1$ (step W6). As a result, when it is judged that the humidity is not less than the first humidity $H_1$, a main charger table is accessed using the detected absolute humidity as an address, and corresponding additional data G is read out (step W7). The additional data G read out, together with additional data E and main charger driving time adjustment data F, is added to main charger reference data $K_2$, so that main charger voltage data $C_2$ is produced (step W8). On the other hand, when the detected humidity is less than the first humidity $H_1$, a voltage to be applied to a main charger is not adjusted depending on the humidity.

10 Claims, 14 Drawing Sheets

FIG. 4

TEMPERATURE TABLE

| TEMPERATURE (℃) | ADDITIONAL DATA E |
|---|---|
| 0 | +43 |
| 1 | +41 |
| 2 | +39 |
| 3 | +37 |
| 4 | +36 |
| 5 | +34 |
| 6 | +32 |
| 7 | +31 |
| 8 | +29 |
| 9 | +27 |
| 10 | +26 |
| 11 | +24 |
| 12 | +22 |
| 13 | +20 |
| 14 | +19 |
| 15 | +17 |
| 16 | +15 |
| 17 | +14 |
| 18 | +12 |
| 19 | +10 |
| 20 | +9 |
| 21 | +7 |
| 22 | +5 |
| 23 | +3 |
| 24 | +2 |
| 25 | 0 |
| 26 | 0 |
| 27 | 0 |
| 28 | 0 |
| 29 | 0 |
| 30 | 0 |

FIG. 5

TONER SENSOR TABLE

| ABSOLUTE HUMIDITY (g/m³) | ADDITIONAL DATA A |
|---|---|
| 0.0 | +87 |
| 0.5 | +81 |
| 1.0 | +74 |
| 1.5 | +68 |
| 2.0 | +62 |
| 2.5 | +56 |
| 3.0 | +51 |
| 3.5 | +45 |
| 4.0 | +40 |
| 4.5 | +34 |
| 5.0 | +29 |
| 5.5 | +24 |
| 6.0 | +19 |
| 6.5 | +14 |
| 7.0 | +9 |
| 7.5 | +5 |
| 8.0 | −0 |
| 8.5 | −5 |
| 9.0 | −9 |
| 9.5 | −13 |
| 10.0 | −17 |
| 10.5 | −22 |
| 11.0 | −26 |
| 11.5 | −30 |
| 12.0 | −33 |
| 12.5 | −37 |
| 13.0 | −41 |
| 13.5 | −45 |
| 14.0 | −48 |
| 14.5 | −52 |
| 15.0 | −55 |

| ABSOLUTE HUMIDITY (g/m³) | ADDITIONAL DATA A |
|---|---|
| 15.5 | −58 |
| 16.0 | −61 |
| 16.5 | −65 |
| 17.0 | −68 |
| 17.5 | −71 |
| 18.0 | −74 |
| 18.5 | −77 |
| 19.0 | −80 |
| 19.5 | −82 |
| 20.0 | −85 |
| 20.5 | −88 |
| 21.0 | −90 |
| 21.5 | −93 |
| 22.0 | −95 |
| 22.5 | −98 |
| 23.0 | −100 |
| 23.5 | −103 |
| 24.0 | −105 |
| 24.5 | −107 |
| 25.0 | −109 |
| 25.5 | −109 |
| 26.0 | −109 |
| 26.5 | −109 |
| 27.0 | −109 |
| 27.5 | −109 |
| 28.0 | −109 |
| 28.5 | −109 |
| 29.0 | −109 |
| 29.5 | −109 |
| 30.0 | −109 |

FIG. 6

MAIN CHARGER TABLE

| ABSOLUTE HUMIDITY (g/m³) | ADDITIONAL DATA G |
|---|---|
| 18.5 | −2 |
| 19.0 | −4 |
| 19.5 | −6 |
| 20.0 | −8 |
| 20.5 | −10 |
| 21.0 | −12 |
| 21.5 | −14 |
| 22.0 | −16 |
| 22.5 | −18 |
| 23.0 | −20 |
| 23.5 | −22 |
| 24.0 | −24 |
| 24.5 | −27 |
| 25.0 | −29 |
| 25.5 | −31 |
| 26.0 | −33 |
| 26.5 | −35 |
| 27.0 | −37 |
| 27.5 | −39 |
| 28.0 | −41 |
| 28.5 | −43 |
| 29.0 | −45 |
| 29.5 | −47 |
| 30.0 | −49 |

FIG. 7

LIGHT SOURCE TABLE

| ABSOLUTE HUMIDITY (g/m³) | ADDITIONAL DATA I |
|---|---|
| 20.5 | −1 |
| 21.0 | −1 |
| 21.5 | −2 |
| 22.0 | −2 |
| 22.5 | −3 |
| 23.0 | −3 |
| 23.5 | −4 |
| 24.0 | −4 |
| 24.5 | −5 |
| 25.0 | −5 |
| 25.5 | −6 |
| 26.0 | −6 |
| 26.5 | −7 |
| 27.0 | −7 |
| 27.5 | −8 |
| 28.0 | −8 |
| 28.5 | −9 |
| 29.0 | −9 |
| 29.5 | −10 |
| 30.0 | −10 |

FIG. 8

TRANSFER CHARGER TABLE

| ABSOLUTE HUMIDITY ($g/m^3$) | ADDITIONAL DATA J |
|---|---|
| 25.0 | −1 |
| 25.5 | −1 |
| 26.0 | −1 |
| 26.5 | −1 |
| 27.0 | −1 |
| 27.5 | −1 |
| 28.0 | −1 |
| 28.5 | −1 |
| 29.0 | −1 |
| 29.5 | −1 |
| 30.0 | −1 |

METHOD OF ADJUSTING IMAGE FORMING CONDITIONS AND IMAGE FORMING APPARATUS TO WHICH THE METHOD IS APPLIED

CROSS REFERENCE TO RELATED APPLICATION

This invention is based on an application No. 8-284310 filed in Japan, the content of which is incorporated hereinto by reference.

BACKGROUND OF THE INVENTION

1. Field of the Invention

The present invention relates generally to an electrophotographic image forming apparatus such as a copying machine, a printer, or a facsimile. More particularly, it relates to a method of adjusting image forming conditions in an image forming apparatus.

2. Description of the Prior Art

In an electrophotographic copying machine conventionally widely used, a copy image of an original has been formed on a paper sheet in the following manner. When the original is illuminated and scanned by light from a light source, light reflected from the original is introduced into a photoreceptor, so that the surface of the photoreceptor is exposed. The surface of the photoreceptor before the exposure is uniformly charged to a predetermined potential by a main charger. When it is exposed by the light reflected from the original, charge in an exposed portion is eliminated, so that a so-called electrostatic latent image is formed. The electrostatic latent image is developed into a toner image by a developing device, and the toner image is transferred onto the paper sheet by discharge of a transfer charger. Toner on the surface of the paper sheet is fixed upon being heated, to achieve copying.

In such an electrophotographic copying machine, the charging performance of the photoreceptor changes with changes in the atmospheric temperature of the copying machine. As a result, the amount of the toner adhering to the surface of the photoreceptor changes, resulting in non uniformity in the density of the image formed on the paper sheet. Specifically, when the atmospheric temperature rises, a potential on the surface of the photoreceptor is raised. Therefore, the amount of the toner adhering to the surface of the photoreceptor is increased. Accordingly, the image formed on the paper sheet is darkened. On the contrary, when the atmospheric temperature drops, the amount of the toner adhering to the surface of the photoreceptor is decreased. Accordingly, the image is lightened.

In the conventional copying machine, therefore, a temperature sensor has been provided inside the main body of the copying machine, and image forming conditions such as the amount of charging on the photosensitive drum, the amount of exposure, and the amount of toner in the developing device are adjusted on the basis of a detection output of the temperature sensor so that the density of the image formed on the paper sheet is made proper.

The density of the image formed on the paper sheet is affected by not only the change in the atmospheric temperature of the copying machine but also the change in the atmospheric humidity. For example, in the case of a copying machine using a two-component developer, when the humidity is high, the amount of toner adhering to carrier is increased, so that the amount of the toner supplied to the surface of the photoreceptor is increased.

In order to solve not only a problem caused by the change in the temperature but also a problem caused by the change in the humidity, therefore, it has been considered that a humidity sensor is provided in addition to the temperature sensor inside the main body of the copying machine, to suitably adjust the image forming conditions such as the amount of exposure of the photosensitive drum, the amount of charging, and the mixing ratio of the toner to the carrier on the basis of detection outputs of the temperature sensor and the humidity sensor.

In order to adjust each of the above-mentioned image forming conditions on the basis of the detection outputs of the temperature sensor and the humidity sensor, however, the amount of data to be stored in a memory for the adjustment is increased, and control becomes complicated.

SUMMARY OF THE INVENTION

An object of the present invention is to solve the above-mentioned technical problems and to provide a new method of adjusting image forming conditions in an image forming apparatus.

Another object of the present invention is to provide an image forming apparatus employing the above-mentioned method of adjusting the image forming conditions.

According to the present invention, in a case where an image having a desired density is formed by setting a plurality of image forming conditions, the atmospheric humidity of an image forming apparatus is considered. When the atmospheric humidity is less than a first predetermined value, only the first image forming condition out of the image forming conditions set in their standard states is adjusted. On the other hand, when the atmospheric humidity is not less than the first predetermined value, the image forming conditions other than the first image forming condition are also adjusted.

Specifically, when the detected humidity is less than the first predetermined value, only the mixing ratio of toner to carrier is adjusted. If the detected humidity is not less than the first predetermined value and less than a second predetermined value, the mixing ratio of toner to carrier and a voltage applied to charging means are adjusted. Further, when the detected humidity is not less than the second predetermined value and less than a third predetermined value, the mixing ratio of toner to carrier, the voltage applied to the charging means and the amount of light from a light source are adjusted. Further, when the atmospheric humidity is not less than the third predetermined value, all the image forming conditions are adjusted.

Although the image forming conditions are thus adjusted on the basis of the atmospheric humidity, only the minimum essential image forming conditions are adjusted depending on the change in the atmospheric humidity, to simplify the adjustment. Consequently, the image forming conditions considering the atmospheric humidity can be adjusted, so that a high-quality image having a desired density can be formed, and the adjustment is simple. Further, the amount of data in adjustment data tables required for the adjustment may be small.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 4 is a diagram showing one example of a temperature table;

FIG. 5 is a diagram showing one example of a toner sensor table;

FIG. 6 is a diagram showing one example of a main charger table;

FIG. 7 is a diagram showing one example of a light source table;

FIG. 8 is a diagram showing one example of a transfer charger table;

DESCRIPTION OF THE PREFERRED EMBODIMENTS

Embodiments of the present invention will be described in detail with reference to accompanying drawings.

Figure 1:
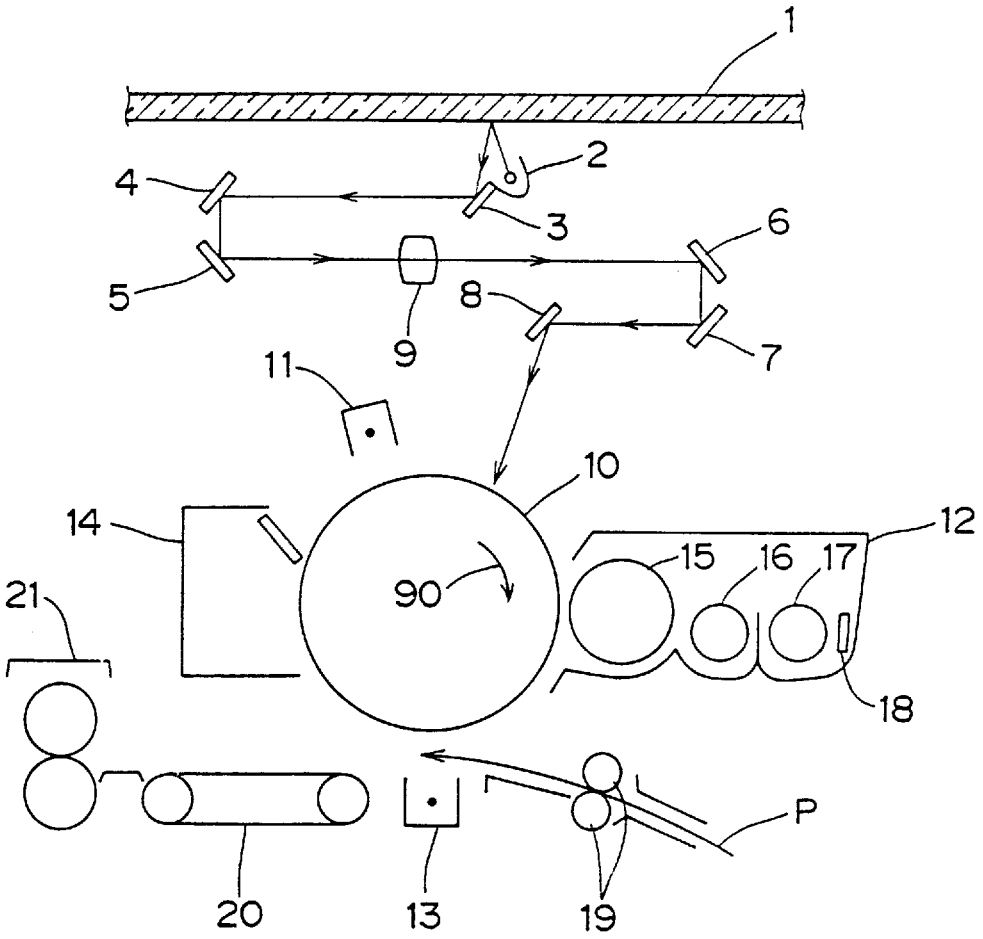
FIG. 1 is a schematic explanatory view showing the construction of a principal part of a copying machine according to one embodiment of the present invention.

FIG. 1 is a schematic explanatory view showing the construction of a principal part of a copying machine according to one embodiment of the present invention. The copying machine is provided with a transparent platen 1 on which an original (not shown) is to be put. An optical system including a light source 2 having a halogen lamp, for example, a first mirror 3, a second mirror 4, a third mirror 5, a fourth mirror 6, a fifth mirror 7, a sixth mirror 8, and a lens 9 is provided below the transparent platen 1.

The original on the transparent platen 1 is illuminated and scanned by the light source 2. A voltage determined by light source voltage adjusting processing as described later is applied to the light source 2, light emitted from the light source 2 is reflected by the original, and the reflected light is introduced into the second mirror 4 by the first mirror 3. The light from the first mirror 3 is introduced into the lens 9 after its optical path is turned by the second mirror 4 and the third mirror 5. The optical path of the light focused by the lens 9 is turned again by the fourth mirror 6 and the fifth mirror 7. The light from the fifth mirror 7 is reflected by the sixth mirror 8, and is supplied to an image forming system as described below after its optical path is turned downward.

The image forming system is positioned below the optical system, and is surrounded by a light shading frame (not shown) so that it is not exposed to light except that the light from the optical system is incident thereon. The image forming system is provided with a photosensitive drum 10 rotated in a direction indicated by an arrow 90 at a predetermined speed when a main motor 28 (see FIG. 3) is turned on at the time of a copying operation. A main charger 11, a developing device 12, a transfer charger 13, and a cleaner 14 are arranged in this order in accordance with the direction of rotation around the photosensitive drum 10. Further, the light reflected by the sixth mirror 8 in the optical system is gathered on the surface of the photosensitive drum 10 between the main charger 11 and the developing device 12.

The main charger 11 is discharged toward the photosensitive drum 10 when a voltage determined by main charger voltage adjusting processing as described later is applied. The surface of the photosensitive drum 10 is uniformly charged to a predetermined potential by the discharge. The surface of the photosensitive drum 10 uniformly charged is exposed by the light reflected by the original which is supplied from the optical system, so that charge on an exposed portion is eliminated. Consequently, a region having charge corresponding to an inverted image of the original and a region having no charge occur on the surface of the photosensitive drum 10, so that a so-called electrostatic latent image is formed.

The surface of the photosensitive drum 10 on which the electrostatic latent image has been formed is then positioned opposite to the developing device 12, so that toner adheres to the region having charge. The developing device 12 comprises a developing roller 15 for supplying the toner to the surface of the photosensitive drum 10, and a left developing spiral 16 and a right developing spiral 17 for agitating-a developer in the developing device 12. The used developer is a two-component developer comprising toner and carrier, and the mixing ratio of the toner to the carrier is adjusted on the basis of mixing ratio adjusting processing as described later.

When the toner and the carrier are agitated upon driving the left developing spiral 16 and the right developing spiral 17, the toner is charged by the friction with the carrier, to adhere to the surface of the carrier. The carrier on which the toner adheres adheres to a peripheral surface of the developing roller 15 by a magnetic force, to form so-called bristles of the developer. When the bristles are brought into contact with the electrostatic latent image formed on the surface of the photosensitive drum 10, the toner is moved to the region having charge, so that the electrostatic latent image is developed into a toner image. Further, a toner sensor 18 for detecting the mixing ratio of the toner to the carrier is disposed in the developing device 12.

When the photosensitive drum 10 is further rotated, the toner image on the surface of the photosensitive drum 10 is positioned opposite to the transfer charger 13 provided below the photosensitive drum 10. On the other hand, a registration roller 19 located in the vicinity of the photosensitive drum 10 is driven to rotate at timing synchronized with the timing at which the toner image is positioned opposite to the transfer charger 13, so that a paper sheet P is sent. A voltage determined by transfer charger voltage adjusting processing as described later is applied to the transfer charger 13, so that the transfer charger 13 is discharged. Consequently, the toner on the surface of the photosensitive drum 10 is moved to the paper sheet P, to adhere to the paper sheet P.

The paper sheet P on which the toner image has been transferred is conveyed by a conveying belt 20 to a fixing device 21, so that the toner is fixed to the paper sheet P by the fixing device 21. The paper sheet P after the fixing processing is discharged outward from the main body of the copying machine by a conveying mechanism (not shown). Further, the toner remaining on the surface of the photosensitive drum 10 is cleaned by the cleaner 14.

The foregoing is one cycle of image formation.

Figure 2:
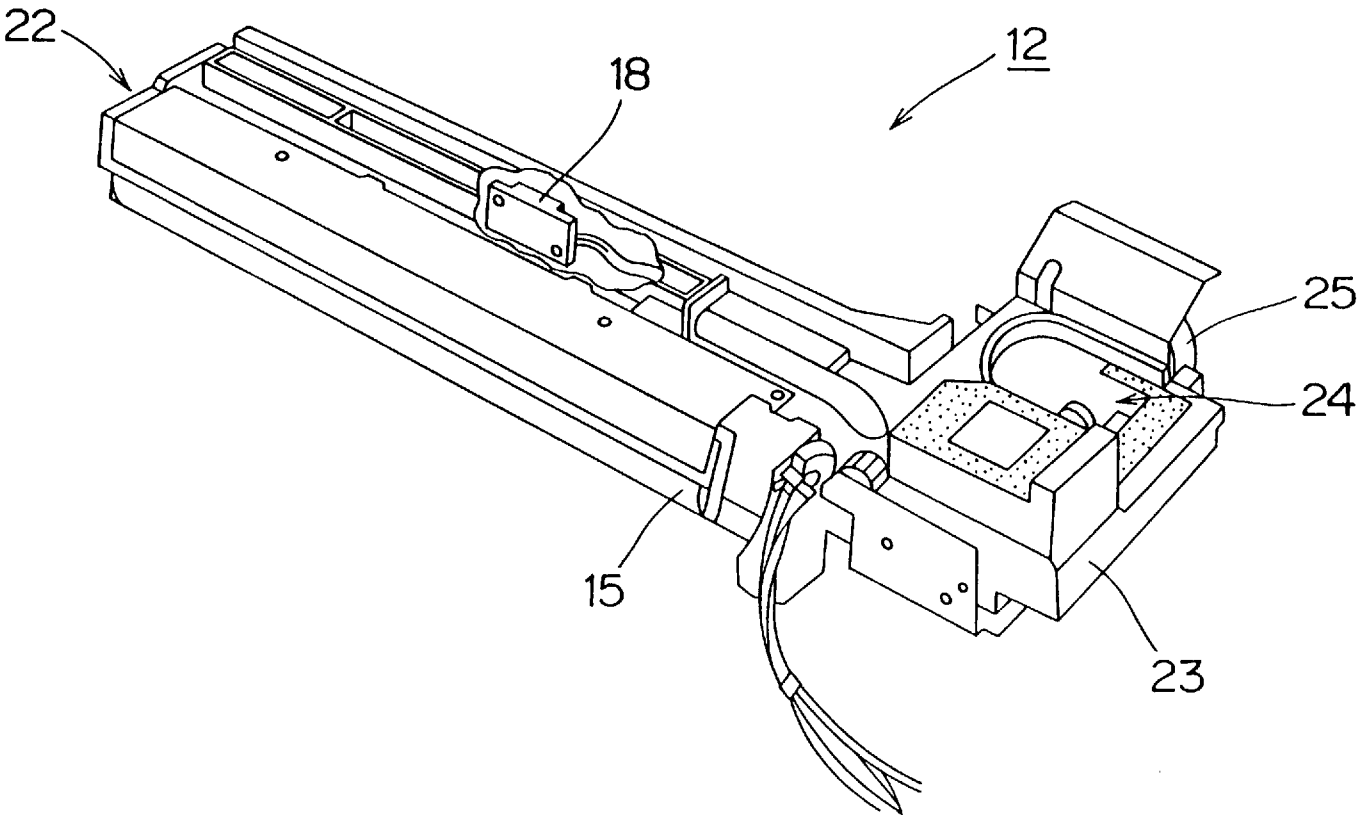
FIG. 2 is a partially cutaway view in perspective of a developing device provided in the copying machine.

FIG. 2 is a partially cutaway view in perspective of the developing device 12, which shows a state where the developing device 12 is viewed from the side of the photosensitive drum 10. Referring to FIG. 2, the developing device 12 will be further described.

The developing device 12 comprises a developing section 22 comprising the developing roller 15, the left developing spiral 16 and the right developing spiral 17 shown in FIG. 1, and the toner sensor 18, and a toner hopper 23 for supplying toner to the developing section 22. A cartridge connection port 24 is formed on the upper surface of the toner hopper 23, and a toner cartridge (not shown) storing toner in its inner part is connected to the cartridge connection port 24. The toner in the toner cartridge is supplied to the toner hopper 23 through the cartridge connection port 24 by natural drop.

The toner hopper 23 comprises a toner hopper spiral (not shown) for conveying the toner in the toner hopper 23 to the developing section 22. The toner hopper spiral is connected to a toner supply motor 25. When the toner supply motor 25 is driven in accordance with control as described later, the toner hopper spiral is driven to rotate by its driving force, so that the toner in the toner hopper 23 is supplied to the developing section 22. Consequently, the amount of the toner supplied to the developing section 22 from the toner hopper 23 can be controlled by controlling the driving/stop of the toner supply motor 25. Further, the mixing ratio of the toner to the carrier in the developing section 22 can be adjusted.

The density of the image formed on the paper sheet P by the image forming operation described with reference to FIG. 1 can be adjusted by methods listed below.

The first method is a method of adjusting the mixing ratio of the toner to the carrier in the developer in the developing section 22. If the ratio of the toner to the carrier is increased, the amount of the toner adhering to the carrier is increased, so that the amount of the toner moved to the photosensitive drum 10 is increased. Accordingly, the image formed on the paper sheet P is darkened. On the contrary, if the ratio of the toner to the carrier is decreased, the amount of the toner adhering to the carrier is decreased, so that the amount of the toner moved to the photosensitive drum 10 is decreased. Accordingly, the image formed on the paper sheet P is lightened.

The second method is a method of adjusting the voltage applied to the main charger 11. When the voltage applied to the main charger 11 is raised, the main charger 11 is intensely discharged, so that the surface potential on the photosensitive drum 10 is raised. Consequently, the toner is strongly drawn toward the photosensitive drum 10 from the developing roller 15, and the amount of the toner adhering to the surface of the photosensitive drum 10 is increased. Accordingly, the image formed on the paper sheet P is darkened. On the contrary, when the main charger 11 is controlled to lower the surface potential on the photosensitive drum 10, the image formed on the paper sheet P is lightened.

The third method is a method of adjusting the voltage applied to the light source 2. When the voltage applied to the light source 2 is raised, the amount of light reflected from the original is increased, so that the surface potential on the photosensitive drum 10 after the exposure is relatively lowered. Consequently, the amount of the toner moved to the photosensitive drum 10 from the developing roller 15 is decreased. Accordingly, the whole of the image formed on the paper sheet P is lightened. On the contrary, when the voltage applied to the light source 2 is lowered, the surface potential on the photosensitive drum 10 after the exposure is relatively raised due to insufficiency of the amount of light. Accordingly, the whole of the image formed on the paper sheet P is darkened.

The fourth method is a method of adjusting the voltage applied to the transfer charger 14. The toner adhering on the surface of the photosensitive drum 10 can be strongly drawn toward the paper sheet P by raising the voltage applied to the transfer charger 14 and intensely discharging the transfer charger 14. Consequently, the amount of the toner adhering to the paper sheet P is increased. Accordingly, the image formed on the paper sheet P is darkened. On the contrary, if the voltage applied to the transfer charger 14 is lowered, the amount of the toner moved to the paper sheet P from the surface of the photosensitive drum 10 can be decreased. Accordingly, the image formed on the paper sheet P is lightened.

Consequently, the density of the image formed on the paper sheet P can be adjusted by changing the image forming conditions such as the mixing ratio of the toner to the carrier, the voltage applied to the main charger 11, the amount of light from the light source 2, and the voltage applied to the transfer charger 13.

On the other hand, it is known that the density of the image formed on the paper sheet P changes depending on the temperature conditions and the humidity conditions under which the copying machine is employed, as described in the column of the prior art. Specifically, if the temperature rises, the charging capability of the photosensitive drum 10 is increased, so that the potential on the photosensitive drum 10 charged by the main charger 11 is raised. As a result, the amount of the toner adhering to the surface of the photosensitive drum 10 is increased. Accordingly, the image formed on the paper sheet P is darkened. On the contrary, if the temperature drops, the charging capability of the photosensitive drum 10 is decreased, so that the potential on the photosensitive drum 10 charged by the main charger 11 is lowered. As a result, the amount of the toner adhering to the surface of the photosensitive drum 10 is decreased. Accordingly, the image is lightened.

Furthermore, if the humidity is high, the amount of the toner charged by the friction with the carrier is decreased, so that an adhesive force between the toner and the carrier is weakened. Consequently, the amount of the toner moved to the surface of the photosensitive drum 10 from the developing roller 15 is increased. Accordingly, the image formed on the paper sheet P is darkened. On the contrary, when the humidity is low, the amount of the toner moved to the surface of the photosensitive drum 10 from the developing roller 15 is decreased. Accordingly, the image formed on the paper sheet P is darkened.

In the copying machine according to the present invention, there are provided a temperature sensor 26 and a humidity sensor 27 (see FIG. 3) capable of detecting the atmospheric temperature and the atmospheric humidity of the copying machine. The image forming conditions such as the mixing ratio of the toner to the carrier, the voltage applied to the main charger 11, the amount of light from the light source 2, and the voltage applied to the transfer charger 13 are adjusted on the basis of outputs of the sensors, to form an image having a suitable density. The temperature sensor 26 and the humidity sensor 27 are mounted on positions where they are not affected by heat generation from each of sections of the copying machine and can almost accurately detect the temperature and the humidity outside the main body of the copying machine, for example, above the rear surface of the main body of the copying machine.

Figure 3:
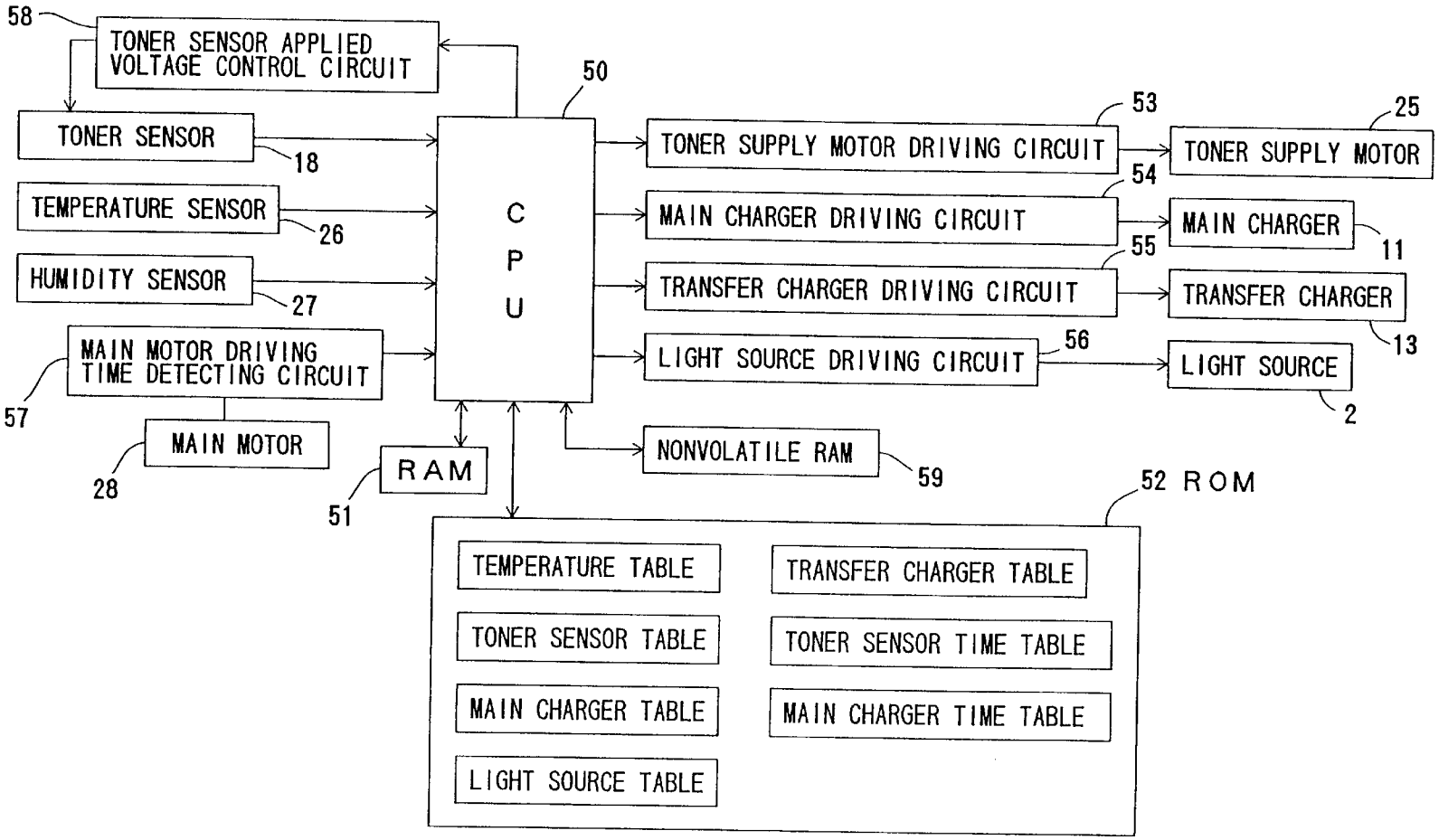
FIG. 3 is a block diagram showing the electrical construction of a principal part of the copying machine.

FIG. 3 is a block diagram showing the electrical construction of a principal part of the copying machine.

The copying machine is provided with a CPU 50 serving as a control center. A RAM 51 and a ROM 52 are connected to the CPU 50. The CPU 50 executes various types of processing in accordance with programs stored in the ROM 52. At this time, the RAM 51 is used as a work area.

Outputs from the toner sensor 18, the temperature sensor 26 and the humidity sensor 27 are fed to the CPU 50. Further, a main motor 28 for driving the photosensitive drum 10 is connected to the CPU 50 through a main motor driving time detecting circuit 57, so that time required to drive the main motor 28 can be detected. The detected time required to drive the main motor 28 is accumulated, and is stored in a nonvolatile RAM 59 as accumulated time required to drive the main motor 28.

Furthermore, a toner supply motor driving circuit 53 for driving the toner supply motor 25, a main charger driving circuit 54 for driving the main charger 11, a transfer charger driving circuit 55 for driving the transfer charger 13, and a light source driving circuit 56 for driving the light source 2 are connected to the CPU 50. Further, a toner sensor applied voltage control circuit 58 for controlling a voltage applied to the toner sensor 18 is connected thereto.

Reference data $K_2$ to be applied to the main charger 11, reference data $K_4$ to be applied to the transfer charger 13, reference data $K_3$ to be applied to the light source 2, and reference data $K_1$ to be applied to the toner sensor 18 are respectively stored at voltage values in the ROM 52 connected to the CPU 50. Further, tables used in image forming conditions adjusting processing are stored in the ROM 52. Specifically, a temperature table, a toner sensor table, a main charger table, a light source table, a transfer charger table, a toner sensor time table, and a main charger time table are stored.

One example of the temperature table is illustrated in FIG. 4. The temperature table is a table used in main charger voltage adjusting processing, and shows how the voltage applied to the main charger 11 should be changed depending on the change in the temperature in order to charge the surface of the photosensitive drum 10 to a predetermined potential irrespective of the temperature conditions under which the copying machine is employed. Specifically, as can be seen from FIG. 4, the table is so set that additional data E added to the reference data $K_2$ increases as the temperature drops.

One example of the toner sensor table is illustrated in FIG. 5. This table is a table used in toner-to-carrier mixing ratio adjusting processing, which shows additional data A added to the reference data $K_1$ depending on the detected absolute humidity. Specifically, as can be seen from FIG. 5, the table is so set that the voltage applied to the toner sensor 18 increases in a state where the humidity is low, while decreasing in a state where the humidity is high.

One example of the main charger table is illustrated in FIG. 6. This table is a table used in main charger voltage adjusting processing, which shows additional data G added to the reference data $K_2$ depending on the detected absolute humidity. Specifically, as can be seen from FIG. 6, the table is so set that the voltage applied to the main charger 11 decreases as the humidity rises.

Furthermore, the adjustment of the voltage applied to the main charger 11 depending on the humidity is not made unless the humidity is not less than a predetermined first humidity $H_1$ (18.5 g/m$^2$), as described later. Consequently, only adjustment data corresponding to humidities of not less than 18.5 g/m$^2$ may be prepared in the main charger table. Therefore, the amount of data to be stored in the ROM 52 may be small.

One example of the light source table is illustrated in FIG. 7. This table is a table used in light source voltage adjusting processing, which shows additional data I added to the reference data $K_3$ depending on the detected absolute humidity. Specifically, as can be seen from FIG. 7, the table is so set that the voltage applied to the light source 2 decreases as the humidity rises.

Furthermore, the adjustment of the voltage applied to the light source 2 depending on the humidity is not made unless the humidity is not less than a predetermined second humidity $H_2$ (20.5 g/m$^2$), as described later. Consequently, only adjustment data corresponding to humidities of not less than 20.5 g/m$^2$ may be prepared in the light source table. Therefore, the amount of data to be stored in the ROM 52 may be small.

One example of the transfer charger table is illustrated in FIG. 8. This table is a table used in transfer charger voltage adjusting processing, which shows additional data J added to the reference data $K_4$ depending on the detected absolute humidity. The adjustment of the voltage applied to the transfer charger 13 depending on the humidity is not made unless the humidity is not less than a predetermined third humidity $H_3$ (25 g/m$^2$), as described later. Consequently, only adjustment data corresponding to humidities of not less than 25 g/m$^2$ may be prepared in the transfer charger table. Therefore, the amount of data to be stored in the ROM 52 may be small.

In the present embodiment, all the additional data J are "−1". Therefore, such a table may be replaced with a simple table holding the additional data J="−1" when the absolute humidity is not less than 25.0 (g/m$^3$).

Figure 9:
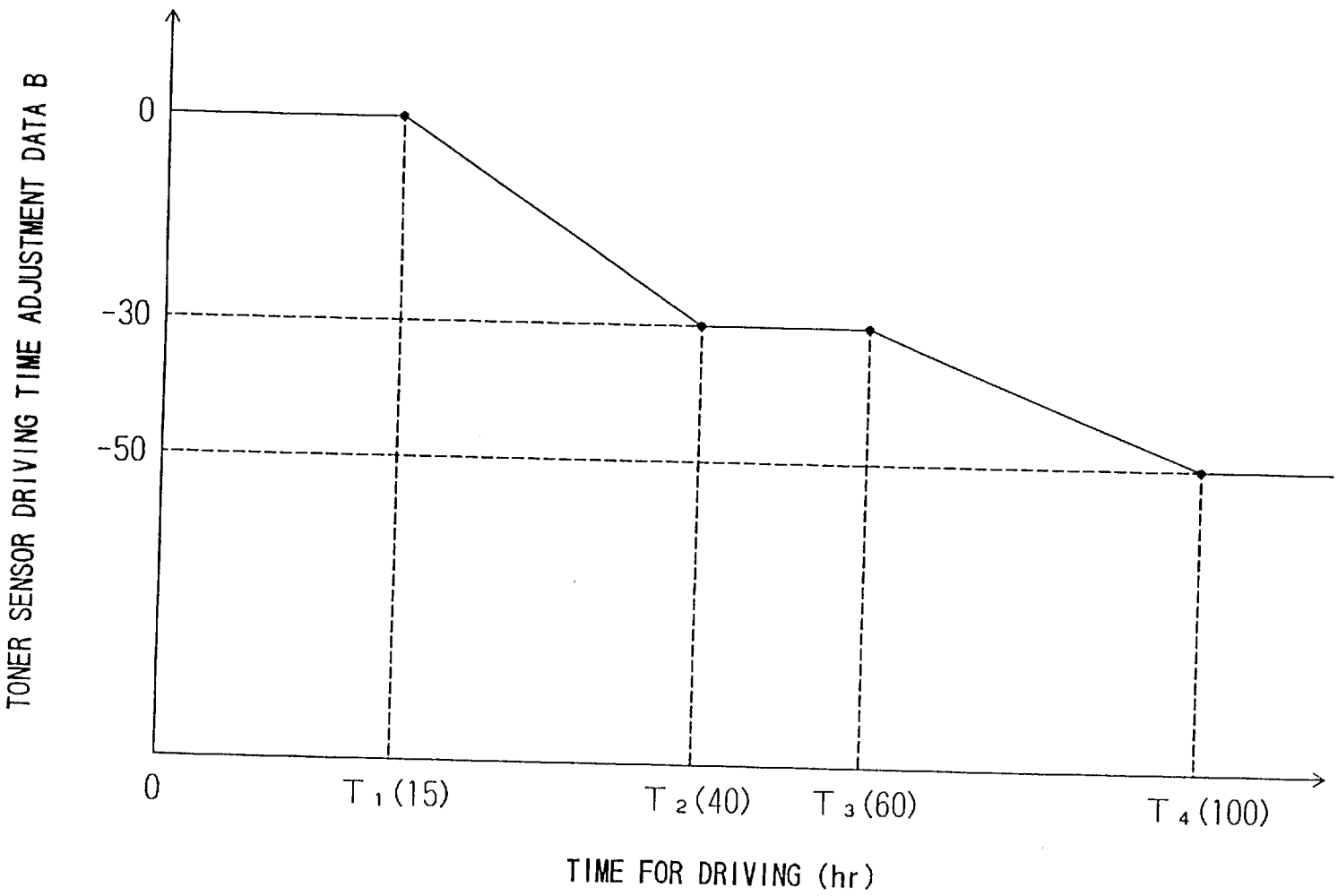
FIG. 9 is a diagram showing one example of the contents of a toner sensor time table.

The toner sensor time table is a table produced on the basis of a graph shown in FIG. 9, for adjusting the voltage applied to the toner sensor 18 depending on the accumulated time 0, $T_1$ (15 hours), $T_2$ (40 hours), $T_3$ (60 hours) and $T_4$ (100 hours) required to drive the main motor 28. Further, the main charger time table is a table produced on the basis of a graph shown in FIG. 10, for adjusting the voltage applied to the main charger 11 depending on the accumulated time 0, $U_1$, $U_2$, $U_3$, $U_4$ $U_5$ (hours) required to drive the main motor 28. The voltages applied to the toner sensor 18 and the main charger 11 are thus adjusted depending on the accumulated time required to drive the main motor 28 in order to prevent the amount of the toner moved to the surface of the photosensitive drum 10 from being increased due to degradation of the carrier in the developer with the use of the developer and the decrease in the amount of the toner charged by the friction with the carrier.

The CPU 50 refers to the outputs of the temperature sensor 26 and the humidity sensor 27 at predetermined timing, for example, when a copy start key (not shown) of the copying machine is depressed and immediately before the conveyance of the subsequent paper sheet is started during a continuous copying operation, and produces voltage data to be respectively applied to the main charger 11, the transfer charger 13, the light source 2, and the toner sensor 18 on the basis of the tables stored in the ROM 52. The CPU 50 respectively feeds the produced voltage data to the main charger driving circuit 54, the transfer charger driving circuit 55, the light source driving circuit 56, and the toner sensor applied voltage control circuit 58.

Furthermore, the CPU 50 controls the driving of the toner supply motor 25 through the toner supply motor driving circuit 53 on the basis of the mixing ratio of the toner to the carrier which is detected by the toner sensor 18.

Figure 11:
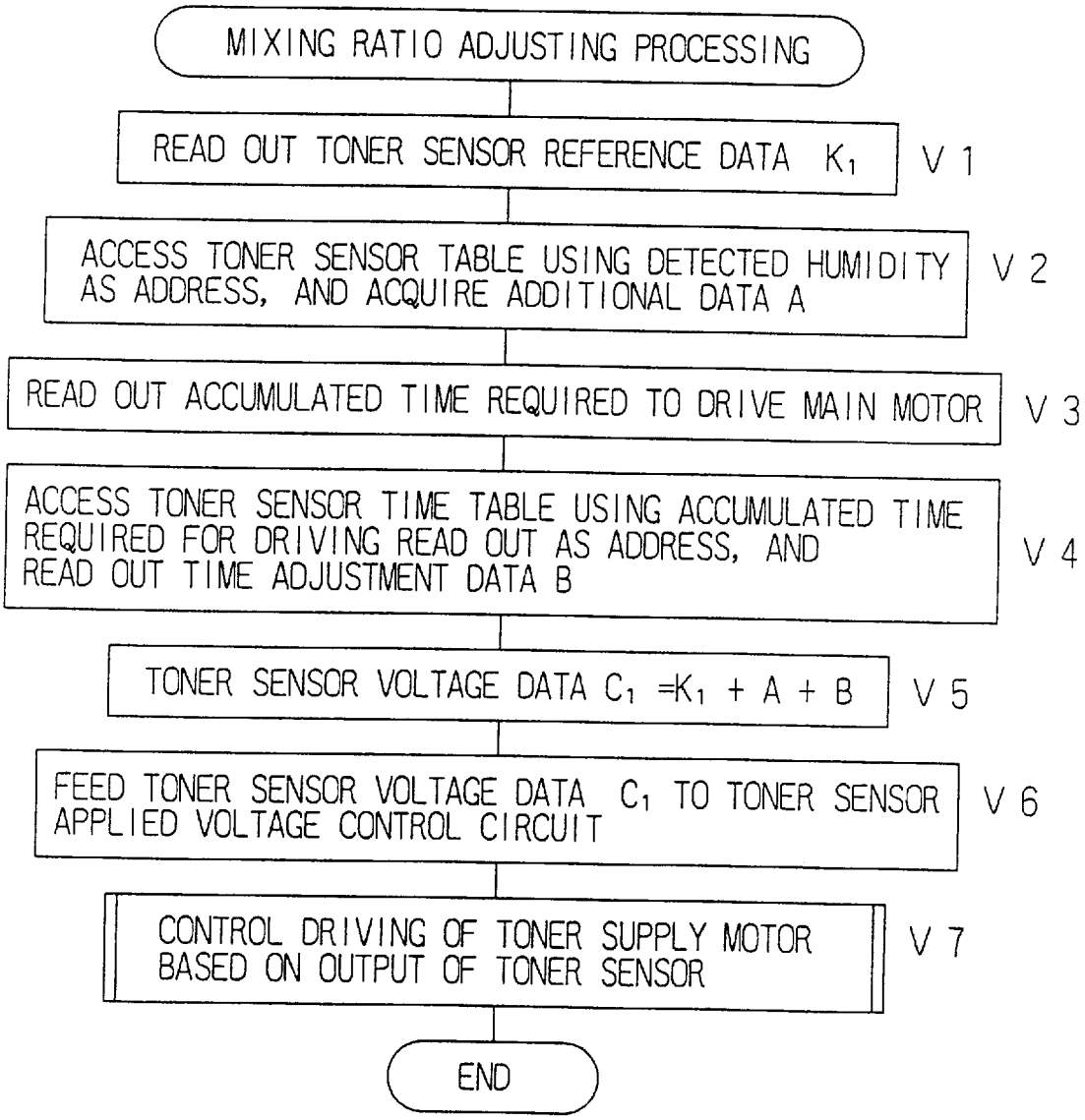
FIG. 11 is a flow chart showing the flow of mixing ratio adjusting processing.

FIG. 11 is a flow chart showing the flow of the mixing ratio adjusting processing performed by the CPU 50. Referring to FIG. 3, the mixing ratio adjusting processing will be described in accordance with the flow of the flow chart shown in FIG. 11.

The toner sensor reference data $K_1$ stored in the ROM 52 is read out by the CPU 50 (step V1). The toner sensor table stored in the ROM 52 is accessed using the detected humidity inputted from the humidity sensor 27 as an address, and additional data A is acquired (step V2). Referring to FIG. 5, when the humidity detected by the humidity sensor 27 is 15 g/cm$^2$, for example, the additional data A="−55" is read out from the toner sensor table. When the humidity is not less than 30 g/m$^2$, the additional data A="−109" in a case where it is 30 g/m$^2$ is read out.

Returning to FIG. 11, the accumulated time required to drive the main motor 28 is further read out from the nonvolatile RAM 59 (step V3), and is fed as an address to the toner sensor time table stored in the ROM 52, and toner sensor driving time adjustment data B is read out from the toner sensor time table on the basis of the designation of the address (step V4). Referring to FIG. 9, when the accumulated time for driving is 40 hours, the time adjustment data B="−30 "is read out from the toner sensor time table. When the accumulated time for driving exceeds 100 hours, the time adjustment data B="−50" is read out.

Returning to FIG. 11 again, in the step V5, the additional data A and the time adjustment data B are added to the toner sensor reference data $K_1$, so that toner sensor voltage data $C_1$ to be applied to the toner sensor 18 is produced.

The produced toner sensor voltage data $C_1$ is fed to the toner sensor applied voltage control circuit 58 (step V6). Consequently, a voltage corresponding to the toner sensor voltage data $C_1$ is applied to the toner sensor 18 from the toner sensor applied voltage control circuit 58. The CPU 50 controls the driving of the toner supply motor 25 on the basis of an output of the toner sensor 18 at this time (step V7).

Specifically, in the step V7, it is judged whether or not an output voltage of the toner sensor 18 is not less than a predetermined ON voltage. If the output voltage is not less than the ON voltage, the toner supply motor 25 is driven, so that the toner in the toner hopper 23 is supplied to the developing section 22. Further, if the output voltage of the toner sensor 18 is not more than a predetermined OFF voltage during the driving of the toner supply motor 25, the driving of the toner supply motor 25 is stopped.

Consequently, an insufficient toner state is virtually formed to supply the toner to the developing section 22 by raising a voltage inputted to the toner sensor 18 to set the output voltage of the toner sensor 18 to not less than the ON voltage. Consequently, the ratio of the toner to the carrier can be increased. On the contrary, if the voltage inputted to the toner sensor 18 is lowered to set the output voltage of the toner sensor 18 to not more than the OFF voltage, no toner is supplied, so that the amount of the toner is decreased as an image is formed. Consequently, the ratio of the toner to the carrier can be decreased.

The toner sensor table is thus accessed by the atmospheric humidity of the copying machine detected by the humidity sensor 27, and the additional data A is read out from the table so that the voltage inputted to the toner sensor 18 is adjusted. The driving of the toner supply motor 25 is controlled on the basis of the output of the toner sensor 18 at this time. Consequently, an image having a proper density can be formed on a paper sheet irrespective of the change in the atmospheric humidity used.

In actually conducting a test for forming an image under various humidity conditions, it is made clear that when the atmospheric humidity of the copying machine is too high, an image having a proper density cannot be formed only by adjusting the mixing ratio of the toner to the carrier. If the humidity detected by the humidity sensor 27 is not less than the predetermined first humidity $H_1$ (for example, 18.5 g/m$^2$), therefore, the image forming conditions other than the mixing ratio of the toner to the carrier are also adjusted.

Figure 12:
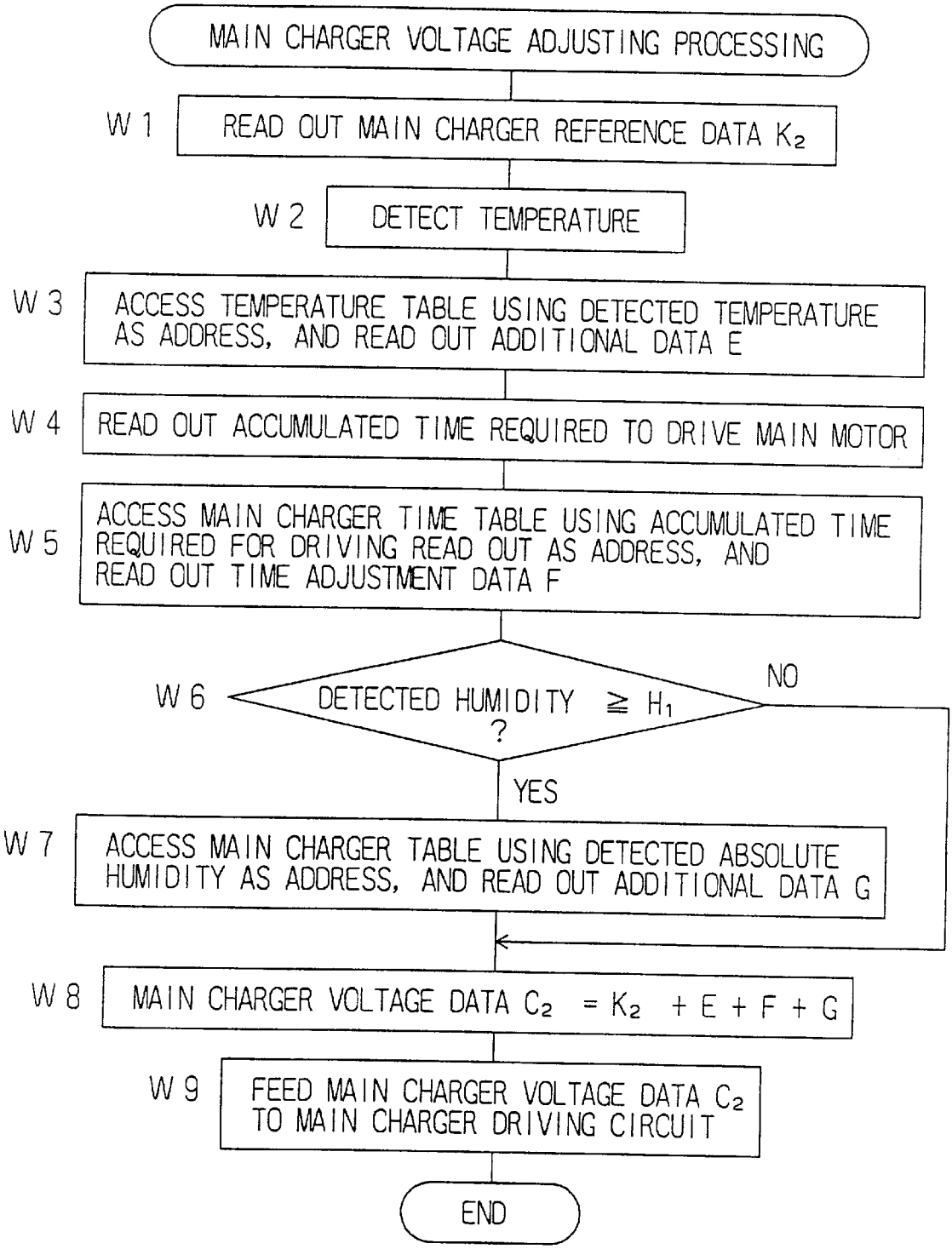
FIG. 12 is a flow chart showing the flow of main charger voltage adjusting processing.

FIG. 12 is a flow chart showing the flow of the main charger voltage adjusting processing. The main charger voltage adjusting processing will be described in accordance with the flow of the flow chart shown in FIG. 12 while referring to FIG. 3.

The main charger reference data $K_2$ stored in the ROM 52 is first read out by the CPU 50 (step W1). An output of the temperature sensor 26 is then referred to (step W2). The temperature table stored in the ROM 52 is accessed using the temperature detected by the temperature sensor 26 as an address, and additional data E is acquired from the temperature table (step W3). Referring to FIG. 4, when the detected temperature is 10° C., for example, the additional data E="26" is read out from the temperature table. When the temperature is not more than 0° C., the additional data E="43" in a case where the temperature is 0° C. is read out from the temperature table. Further, when the temperature is not less than 25° C., the correction of the voltage applied to the main charger 11 using the temperature is not made.

Figure 10:
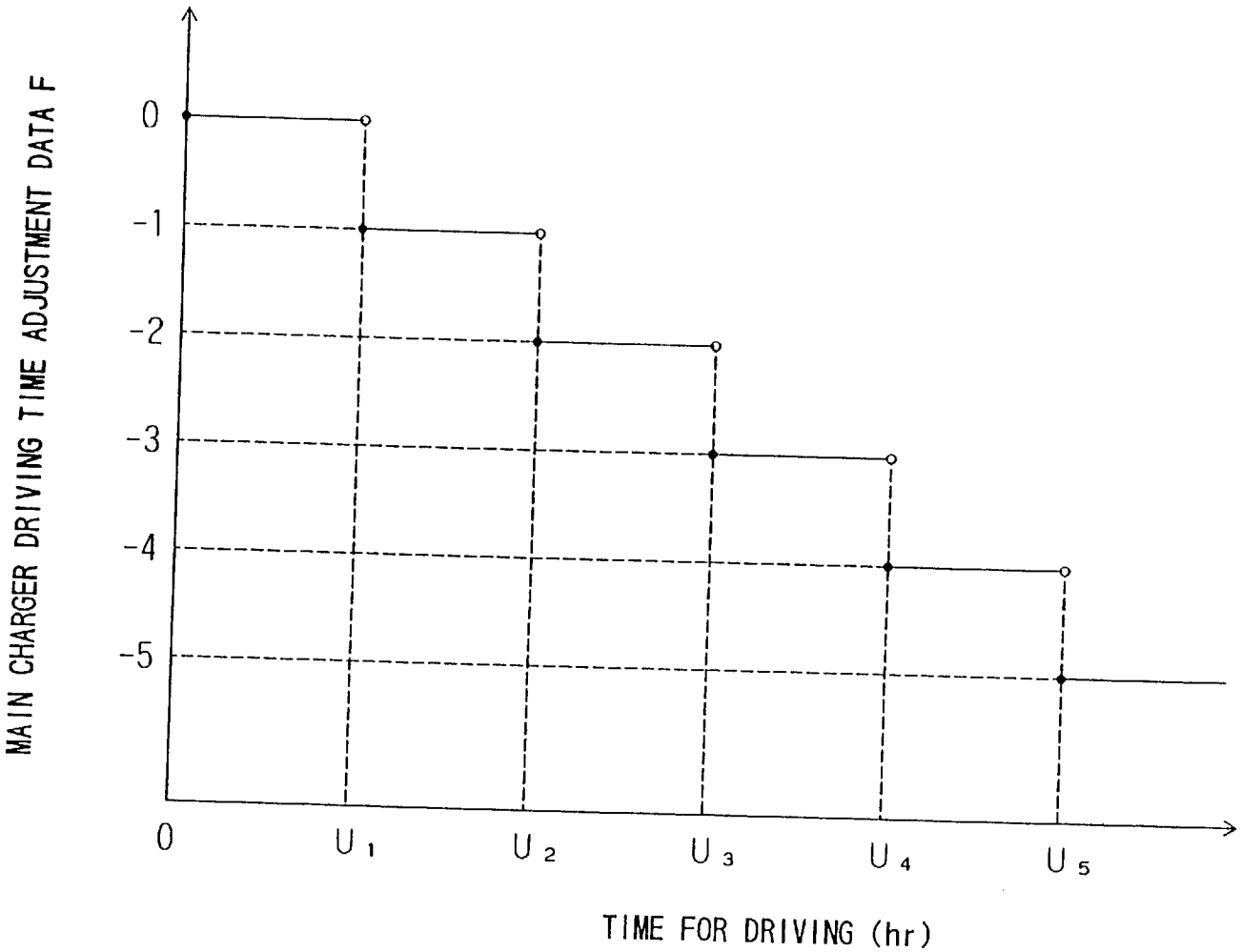
FIG. 10 is a diagram showing one example of the contents of a main charger time table.

Returning to FIG. 12, the accumulated time required to drive the main motor 28 is read out from the nonvolatile RAM 59 in the step W4, and is fed as an address to the main charger time table stored in the ROM 52. Main charger driving time adjustment data F is read out from the main charger time table on the basis of the designation of the address (step W5). Referring to FIG. 10, when the accumulated time for driving is $U_1$ hours, for example, the time adjustment data F="−1" is read out. When the accumulated time for driving exceeds predetermined $U_5$ hours, the time adjustment data F="−5" is read out.

Returning to FIG. 12, it is judged whether or not the humidity detected by the humidity sensor 27 is not less than the predetermined first humidity $H_1$ (for example, 18.5 g/m$^2$) subsequently to the step W5 (step W6). When the detected humidity is not less than the first humidity $H_1$, the judgment in the step W6 is affirmed, after which the program proceeds to the step W7. In the step W7, the main charger table is accessed using the detected absolute humidity as an address. Consequently, corresponding additional data G is read out. Referring to FIG. 6, when the detected humidity is 25 g/m$^2$ for example, the additional data G="−29 " is read out.

Returning to FIG. 12 again, the additional data E, the time adjustment data F and the additional data G are added to the main charger reference data $K_2$ in the step W8, so that main charger voltage data $C_2$ is produced.

On the other hand, when the humidity detected by the humidity sensor 27 is less than the first humidity $H_1$, and the judgment in the step W6 is denied, the processing in the step W7 is omitted, after which the program proceeds to the step W8. In the step W8, the additional data E and the time adjustment data F are added to the main charger reference data $K_2$, so that main charger voltage data $C_2$ is produced. Although in FIG. 12, the main charger voltage data $C_2 = K_2 + E + F + G$, G may be considered to be zero when the judgment in the step W6 is denied.

When the main charger voltage data $C_2$ thus produced is fed to the main charger driving circuit 54 (step W9), a voltage corresponding to the main charger voltage data $C_2$ is applied to the main charger 11.

When the absolute humidity detected by the humidity sensor 27 is thus less than the predetermined first humidity $H_1$, the processing in the step W7 is omitted. In other words, if the detected humidity is not less than the predetermined first humidity $H_1$, a voltage to be applied to the main charger 11 is adjusted depending on the humidity.

Figure 13:
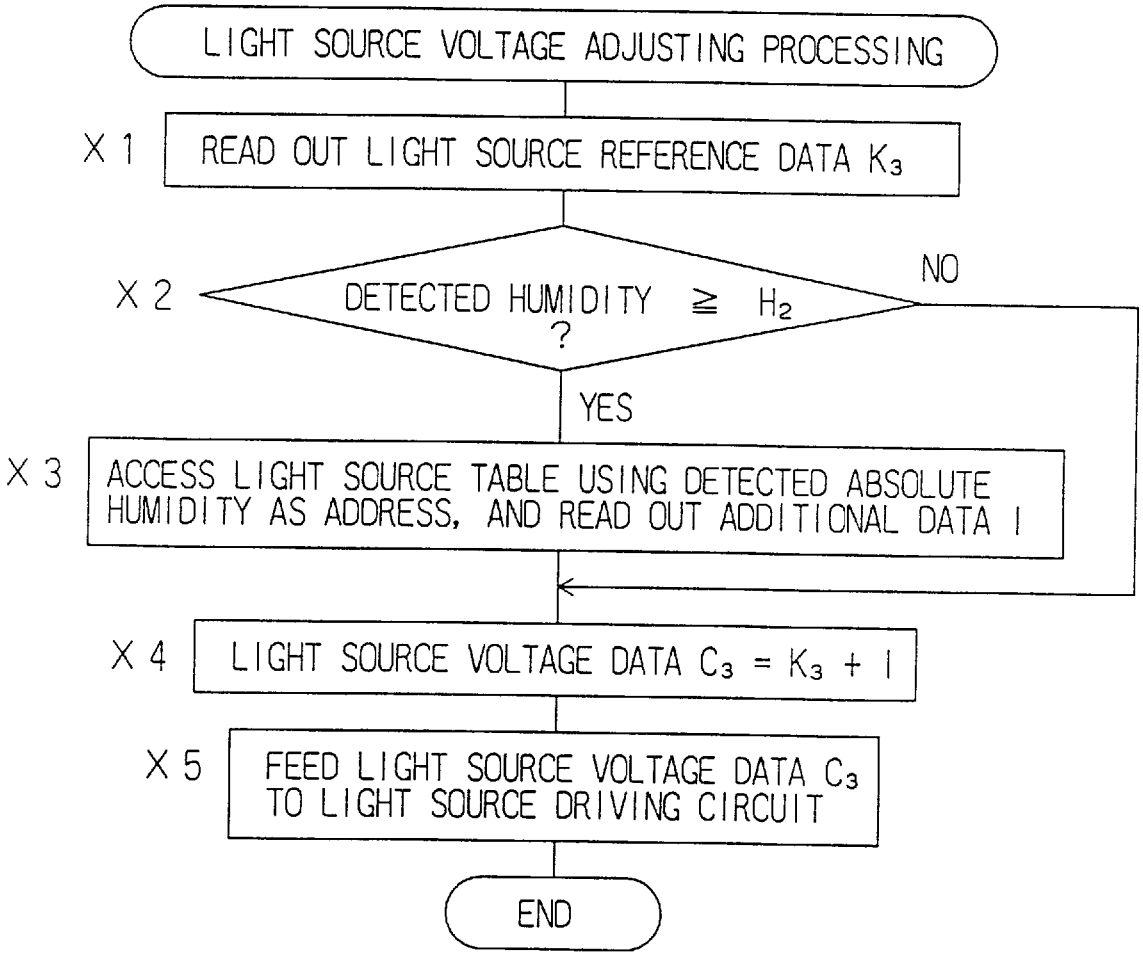
FIG. 13 is a flow chart showing the flow of light source voltage adjusting processing.

FIG. 13 is a flow chart showing the flow of the light source voltage adjusting processing. The light source voltage adjusting processing will be described in accordance with the flow of the flow chart shown in FIG. 13 while referring to FIG. 3.

The light source reference data $K_3$ stored in the ROM 52 is read out by the CPU 50 (step X1), and it is then judged whether or not the humidity detected by the humidity sensor 27 is not less than the predetermined second humidity $H_2$ (for example, 20.5 g/m$^2$) (step X2). When the detected humidity is not less than the second humidity $H_2$, the judgment in the step X2 is affirmed, after which the program proceeds to the step X3. In the step X3, the detected absolute humidity is used as an address, and is fed to the light source table, and additional data I is read out on the basis of the designation of the address. Referring to FIG. 7, when the detected humidity is 25 g/m$^2$, for example, the additional data I="−5" is read out.

Returning to FIG. 13, in the step X4, the additional data I is added to the reference data $K_3$, so that light source voltage data $C_3$ is produced. When the light source voltage data $C_3$ is fed to the light source driving circuit 56 (step X5), a voltage corresponding to the light source voltage data $C_3$ is applied to the light source 2.

On the other hand, when the humidity detected by the humidity sensor 27 is less than the second humidity $H_2$, and the judgment in the step X2 is denied, the processing in the step X3 is omitted, after which the program proceeds to the step X4. In the step X4, the reference data $K_3$ is taken as light source voltage data $C_3$. That is, when the detected humidity is less than the second humidity $H_2$, the reference data $K_3$ is not adjusted. In other words, when the absolute humidity detected by the humidity sensor 27 is not less than the predetermined second humidity $H_2$, a voltage applied to the light source 2 is adjusted.

Figure 14:
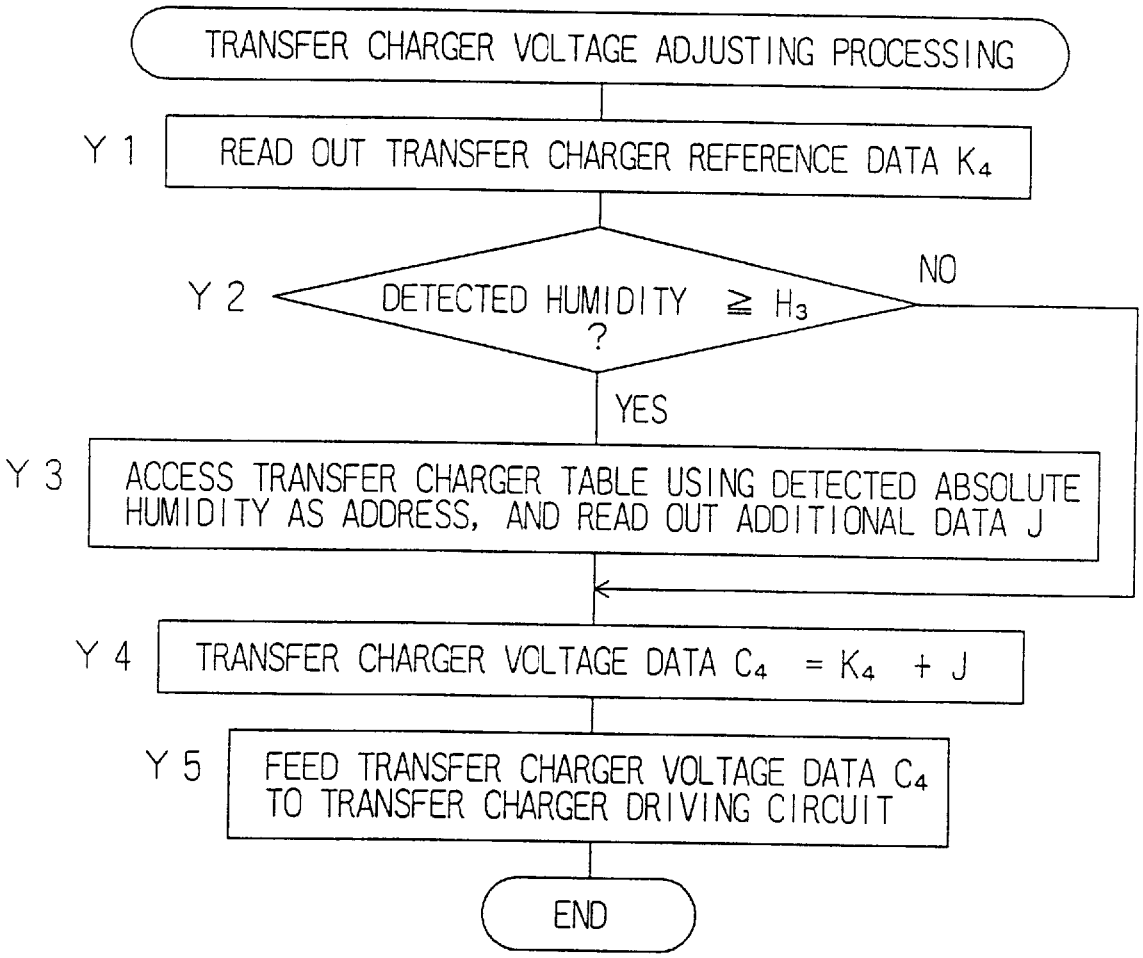
FIG. 14 is a flow chart showing the flow of transfer charger voltage adjusting processing.

FIG. 14 is a flow chart showing the flow of the transfer charger voltage adjusting processing. The light source voltage adjusting processing will be described in accordance with the flow of the flow chart shown in FIG. 14 while referring to FIG. 3.

The transfer charger reference data $K_4$ stored in the ROM 52 is read out by the CPU 50 (step Y1), and it is then judged whether or not the humidity detected by the humidity sensor 27 is not less than the predetermined third humidity $H_3$ (for example, 25 g/m$^2$ ) (step Y2). When the detected humidity is not less than the third humidity $H_3$, the judgment in the step Y2 is affirmed, after which the program proceeds to the step Y3. In the step Y3, the detected absolute humidity is taken as an address, and is fed to the transfer charger table. Additional data J is read out on the basis of the designation of the address. Referring to FIG. 8, in the present embodiment, when the detected humidity is not less than 25 g/m$^2$, the additional data J="−1" is read out.

Returning to FIG. 14, in the step Y4, the additional data J is added to the reference data $K_4$, so that transfer charger voltage data $C_4$ is produced. When the transfer charger voltage data $C_4$ is fed to the transfer charger driving circuit 55 (step Y5), a voltage corresponding to the transfer charger voltage data $C_4$ is applied to the transfer charger 13.

On the other hand, when the humidity detected by the humidity sensor 27 is less than the third humidity $H_3$, and the judgment in the step Y2 is denied, the processing in the step Y3 is omitted, after which the program proceeds to the step Y4. In the step Y4, the transfer charger reference data $K_4$ is taken as transfer charger voltage data $C_4$. That is, when the detected humidity is less than the third humidity $H_3$, the transfer charger reference data $K_4$ is not adjusted. In other words, when the absolute humidity detected by the humidity sensor 27 is not less than the predetermined third humidity $H_3$, a voltage applied to the transfer charger 11 is adjusted.

As described in the foregoing, in adjusting the image forming conditions depending on the humidity detected by the humidity sensor 27 in order to form an image having a proper density, when the atmospheric humidity of the copying machine is less than the first humidity $H_1$, only the mixing ratio of the toner to the carrier is adjusted. The other image forming conditions are adjusted only when the humidity is not less than the first humidity $H_1$, and the humidity cannot be coped with only by the adjustment of the mixing ratio so that an image having a proper density cannot be formed, to make the number of image forming conditions to be adjusted as small as possible.

Even if there is provided the humidity sensor 27, to adjust the image forming conditions depending on the detected humidity, processing for the adjustment is relatively simple. Further, the amount of data to be stored in the ROM 52 may be small.

Although description was made on the basis of specific numerical values shown in FIGS. 4 to 10, the numerical values shown in FIGS. 4 to 10 are obtained by the test and are only one example. Even when the photosensitive drum, the developing roller, and the like used are changed, it is preferable that the specific numerical values shown in FIGS. 4 to 10 are suitably changed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of adjusting, in an image forming apparatus for forming an image having a desired density by a plurality of image forming conditions set, at least one of the image forming conditions, the method comprising the steps of:

detecting a humidity; and adjusting only the first image forming condition out of the plurality of image forming conditions set if the detected humidity is less than a first predetermined value, wherein the step of detecting the humidity includes detecting an absolute humidity, and wherein the adjusting step adjusts only the first image forming condition and the second image forming condition out of the plurality of image forming conditions set if the detected humidity is not less than the first predetermined value and is less than a second predetermined value.

2. The method according to claim 1, wherein the adjusting step is adjusting all the image forming conditions when the detected humidity is not less than the second predetermined value.

3. An image forming apparatus comprising a photoreceptor, charging means for uniformly charging a surface of the photoreceptor to a predetermined potential, means for illuminating and scanning an original by light emitted from a light source to form an electrostatic latent image on the surface of the photoreceptor by reflected light from the original, developing means for developing the formed electrostatic latent image by a developer, and transferring means for transferring the developed electrostatic latent image on a paper sheet, for forming an image having a desired density by setting a predetermined plurality of image forming conditions, further comprising a humidity sensor for detecting the atmospheric humidity of the image forming apparatus, storing means storing an adjustment data table corresponding to the humidity with respect to each of the plurality of image forming conditions;

adjusting means for adjusting, with respect to only the first image forming condition out of the plurality of image forming conditions, a set image forming condition on the basis of the adjustment data table in the storing means when a detection output of the humidity sensor is less than a first predetermined value, while adjusting, with respect to the first image forming condition and the other image forming conditions, a set image forming conditions on the basis of the adjustment data tables in the storing means when the detection output of the humidity sensor is not less than the first predetermined value.

4. The image forming apparatus according to claim 3, wherein adjustment data corresponding to all humidities detected are stored in the adjustment data table corresponding to the first image forming condition, and only adjustment data corresponding to the humidities which are not less than the first predetermined value are stored in the adjustment data tables corresponding to the image forming conditions other than the first image forming condition.

5. The image forming apparatus according to claim 4, wherein the adjusting means makes adjustment on the basis of the adjustment data tables with respect to the first image forming condition and the second image forming condition when the detection output of the humidity sensor is less than a third predetermined value more than a second predetermined value, while making adjustment on the basis of the adjustment data tables with respect to all the image forming conditions when the detection output of the humidity sensor is not less than the third predetermined value.

6. The image forming apparatus according to claim 5, wherein the predetermined plurality of image forming conditions comprise a mixing ratio of toner to carrier in a developer, a voltage applied to the charging means, an amount of light from the light source, and a voltage applied to the transferring means, the first image forming condition being the mixing ratio of toner to carrier in the developer, and second image forming conditions being the voltage applied to the charging means and the amount of light from the light source.

7. The image forming apparatus according to claim 6, wherein the adjusting means adjusts the mixing ratio of toner to carrier in the developer and the voltage applied to the charging means when the detection output of the humidity sensor is not less than the first predetermined value and less than the second predetermined value.

8. The image forming apparatus according to claim 7, wherein the adjusting means adjusts the mixing ratio of toner to carrier in the developer, the voltage applied to the charging means, and the amount of light from the light source when the detection output of the humidity sensor is not less than the second predetermined value and less than the third predetermined value.

9. The image forming apparatus according to claim 8, wherein the adjusting means adjusts all the image forming conditions when the detection output of the humidity sensor is not less than the third predetermined value.

10. The image forming apparatus according to claim 3, wherein the predetermined plurality of image forming conditions comprise a mixing ratio of toner to carrier in a developer, a voltage applied to the charging means, an amount of light from the light source, and a voltage applied to the transferring means, said first image forming condition being the mixing ratio of toner to carrier in the developer.

* * * * *